United States Patent [19]

Kitamura

[11] 4,417,397

[45] Nov. 29, 1983

[54] ELECTRIC SHAVER

[75] Inventor: Masami Kitamura, Osaka, Japan

[73] Assignee: Matsushita Electric Works, Ltd., Kadoma, Japan

[21] Appl. No.: 384,981

[22] Filed: Jun. 4, 1982

[30] Foreign Application Priority Data

Jun. 15, 1981 [JP] Japan ..... 56-92711

[51] Int. Cl.[3] ..... B26B 19/44

[52] U.S. Cl. ..... 30/34.2; 30/41.6

[58] Field of Search ..... 30/41, 41.5, 41.6, 133, 30/34.2

[56] References Cited

U.S. PATENT DOCUMENTS

| | | | |
|---|---|---|---|
| 2,083,579 | 6/1937 | Schmitt | 30/34.2 X |
| 2,376,197 | 5/1945 | Schlotthauer | 30/41 |
| 2,802,260 | 8/1957 | Allen | 30/41.5 |
| 2,916,821 | 12/1959 | Witmer | 30/41.5 |
| 3,328,430 | 8/1974 | Yamada et al. | 30/41.5 |
| 3,571,926 | 3/1971 | Ainsworth | 30/41.5 |
| 4,150,483 | 4/1979 | Kanazawa | 30/133 |
| 4,219,931 | 9/1980 | Vacilotto | 30/41.5 X |

FOREIGN PATENT DOCUMENTS

| | | | |
|---|---|---|---|
| 784909 | 10/1957 | United Kingdom | 30/41.6 |

*Primary Examiner*—Jimmy C. Peters

*Attorney, Agent, or Firm*—Poms, Smith, Lande & Rose

[57] ABSTRACT

An electric shaver incorporating an elastomeric, unitary, diaphragm suction pump driven from an eccentric off the cutting blade driving motor. A channel is formed about the cutting head in communication with the suction pump. During shaving, the suction pump creates a partial vacuum in the channel about the cutting head whereby the skin is drawn into the channel and, thereby, stretched across and against the cutting head. Axial sliding of the cutting head and/or a collar surrounding the channel can be employed in addition to provide self-adjustability.

16 Claims, 10 Drawing Figures

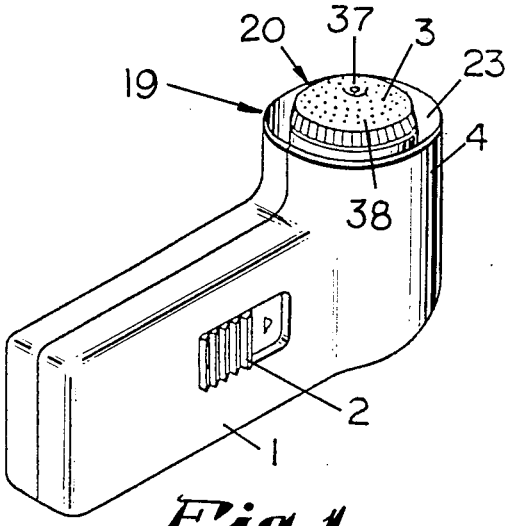
Fig. 1.
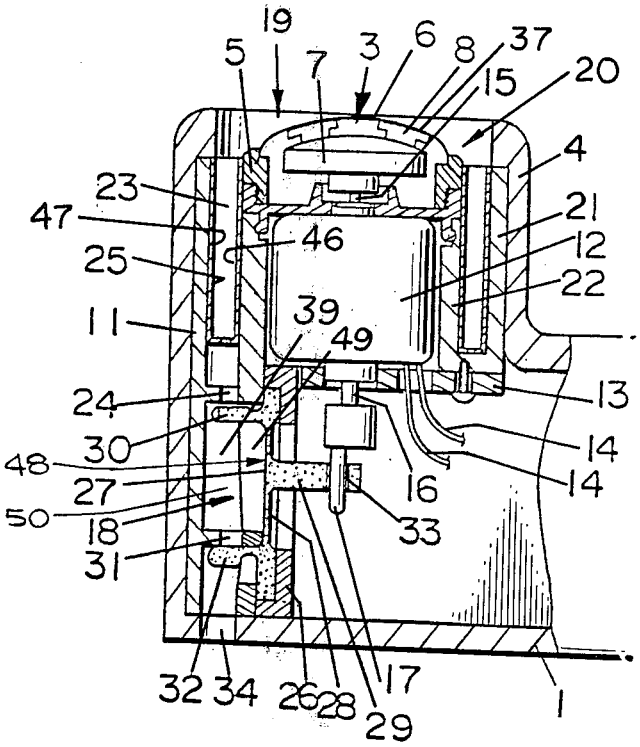
Fig. 2.
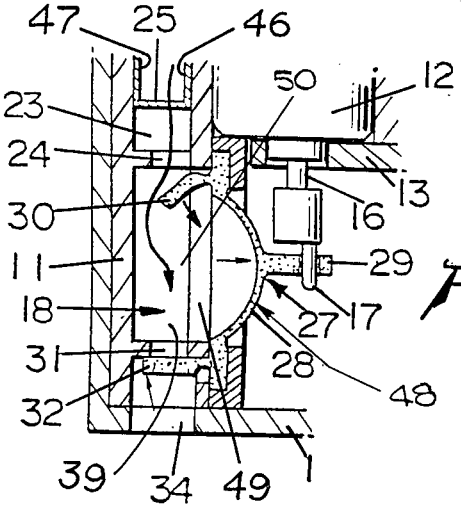
Fig. 3.
Fig. 5.
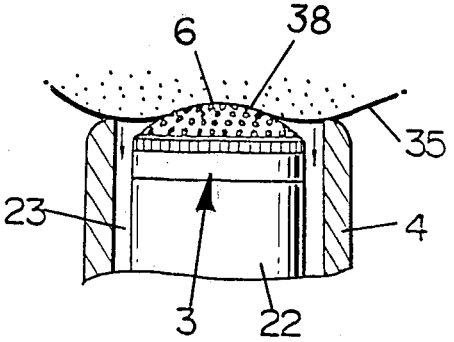
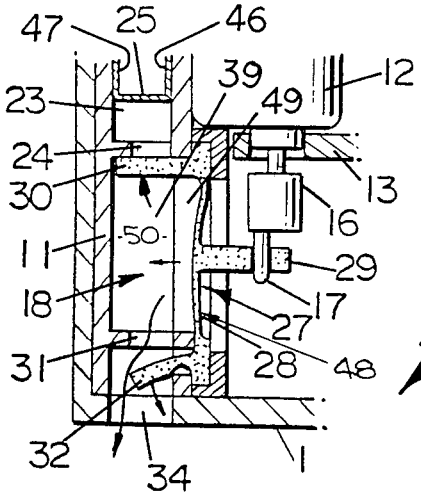
Fig. 4.

Fig. 6.
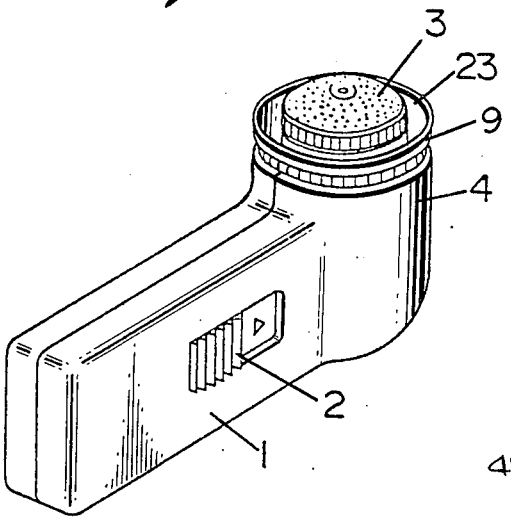
Fig. 7.
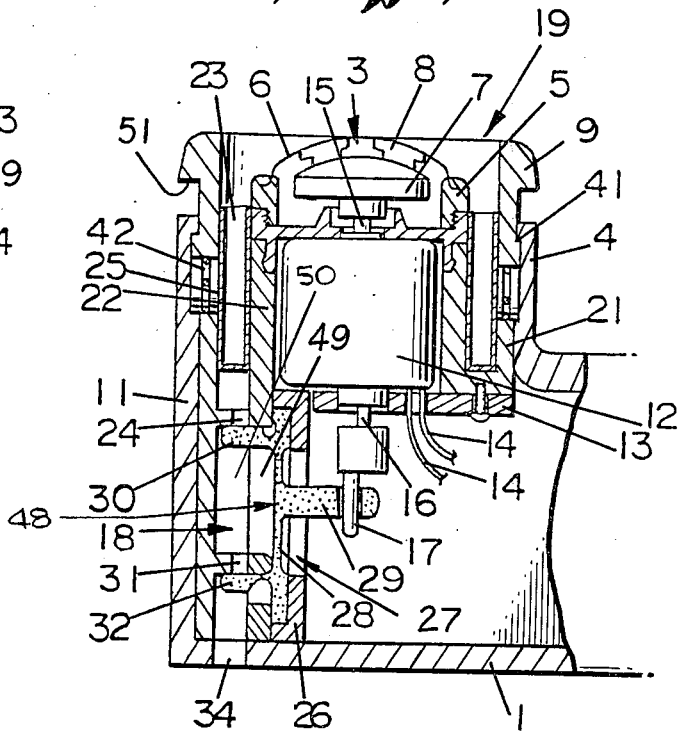
Fig. 8.
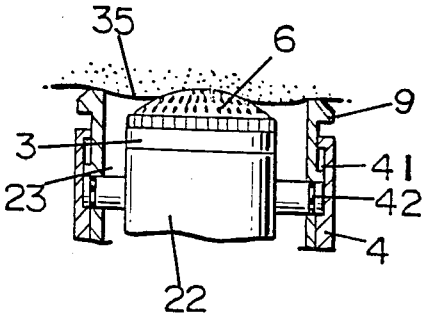
Fig. 9.
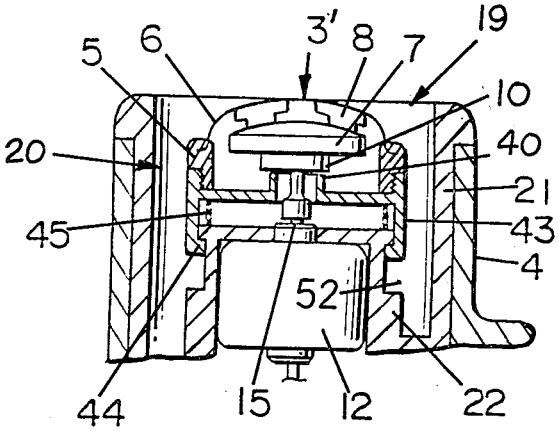
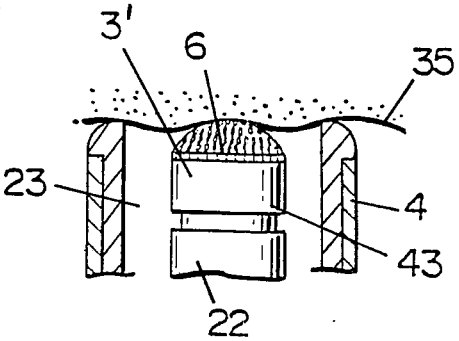
Fig. 10.

ELECTRIC SHAVER

BACKGROUND OF THE INVENTION

The present invention relates to electric shavers and, more particularly, to electric shavers incorporating means for manipulating the skin to effect a closer shave.

Electric dry-shavers as well known in the art. In such shavers, a thin fixed outer member having holes or slots therethrough has blades moved thereagainst on the inner surface in a rotary or reciprocal motion. The hairs of the mustache and beard projecting from the skin pass through the openings in the outer surface and are cut off adjacent the inner surface by the action of the moving inner blades.

It is further known in the art that the skin is depressed adjacent the hair folicles and, therefore, if the skin can be stretched adjacent the point of cutting, the hairs will be thrust outward resulting in a closer shave and a smoother feel when the skin is released.

In larger electric shavers incorporating reciprocal blades, it is possible to put rollers between and adjacent the blade cutting areas to effect a stretching action of the skin as the cutting head of the razor is moved across the face. With smaller rotary action electric shavers, however, the incorporation of such mechanical devices is usually not practical. This is particularly true in small, lightweight, portable shavers where size and weight are at a premium.

Further, in electric shavers, cleanliness is always a consideration. As the whiskers are severed, they tend to often fall as a fine dust which clings to the surrounding area. Thus, the incorporation of means for retaining these severed whiskers for later disposal under controlled circumstances is always desirable.

Wherefore, it is the prime objective of the present invention to provide a method and apparatus for incorporation particularly in small, lightweight electric shavers of the rotary type which will effect stretching of the skin adjacent the cutting head during shaving.

It is a further objective to provide such an electric shaver of the rotary type which also incorporates means for collecting the severed whiskers for later disposal.

SUMMARY

The foregoing objectives have been met in an electric shaver according to the present invention comprising a hollow body portion having a head opening therein; a cutting head disposed in the opening so as to form a channel disposed about the head; a suction pump disposed within the body with an inlet in communication with the channel and an outlet in communication with the atmosphere; and, means disposed in the body portion for driving the cutting head and the suction pump whereby a partial vacuum is created in the channel around the cutting head when the cutting head is being driven to thereby draw the skin into the channel and thereby stretched across and against the cutting head during shaving.

To further obtain the objectives of the present invention, the shaver has a removable filter disposed in the channel opening adjacent the cutting head. In its preferred embodiment, the filter comprises two spaced concentric cylindrical members open at one end and closed together at the opposite end to form an annular cup disposed within the channel opening adjacent the cutting head The filter cup is a disposable filter which can be removed with the whiskers therein and disposed of.

In one modification shown, a collar is disposed within the head opening adjacent the outer periphery. The collar is axially slidable between an extended and retracted position and means are provided for biasing the collar towards the extended position. As another modification, the cutting head is mounted for axial movement between extended and retracted positions and means are provided for biasing the cutting head towards the extended position. Both of these modifications for axial movement could be combined. The axial movement allows the spacing between the cutting head and the periphery of the channel to self-adjust under each particular cutting and skin condition for maximum effectiveness.

DESCRIPTION OF THE DRAWINGS

FIG. 1 is a perspective view of an electric shaver according to the present invention in its basic embodiment.

FIG. 2 is a cutaway side elevation through the cutting head portion of the shaver of FIG. 1.

FIG. 3 is an enlarged cutaway view through the suction pump portion of the shaver of FIG. 2 showing the suction pump during the sucking portion of its cycle.

FIG. 4 is an enlarged cutaway view through the suction pump as shown in FIG. 3 during the expulsion of air portion of its cycle.

FIG. 5 is a simplified partially cutaway slide elevation of the electric shaver of FIGS. 1 and 2 adjacent the skin showing the stretching action thereof.

FIG. 6 is a perspective view of the present invention in an alternate embodiment.

FIG. 7 is a cutaway side elevation of the cutting head portion of the shaver of FIG. 6.

FIG. 8 is a simplified drawing adjacent the skin in the manner of FIG. 5 showing the operation of an axially sliding collar incorporated within the shaver as shown in FIG. 7.

FIG. 9 is a simplified cutaway side elevation of yet another modification to the electric shaver of the present invention incorporating an axially sliding cutting block.

FIG. 10 is a simplified drawing in the manner of FIGS. 5 and 8 showing the operation of the embodiment of FIG. 9 adjacent the skin.

DESCRIPTION OF THE VARIOUS EMBODIMENTS

Referring first, briefly, to FIG. 1, a portable, battery-operated electric shaver of the rotary type according to the present invention is shown in its basic embodiment. The shaver has a housing or body 1 adapted to be held in the hand. The housing 1 is hollow and contains the necessary parts for operation (to be described) including replacable or rechargable batteries (not shown). A switch 2 is provided for turning the shaver off and on. The housing 1 contains a head opening, generally indicated as 19, in which a cutting head, generally indicated as 20, is disposed. The cutting head 20 is spaced from the sidewalls of the head opening 19 to create a channel 23 around the head which acts as an air inlet path in a manner to be discussed in greater detail hereinafter. The air inlet or channel 23 has a partial vacuum created therein in a manner to be described such that the skin is drawn into the channel 23 and, thereby, stretched across and against the cutting head 20 to effect the objects of the invention.

Turning now to FIG. 2, the details of the present invention in its basic embodiment are shown. The head opening 19 is contained within outer cylindrical part 4 of the housing or body 1. The hair cutting portion of the cutting head 20 comprises the blade block, generally indicated as 3, which is composed of spherical outer blades 6 mounted on blade mount 5 and inner blades 8 mounted on inner blade frame 7 for rotation in sliding contact with the inner surface of the outer blades 6. The spherical outer blades 6 are a metal skin 37 having slots or holes 28 therethrough through which the whiskers pass to be severed. This construction is well known in the art and, consequently, no further discussion thereof is necessary.

For ease of construction, a removable separate pump housing 11 is disposed within the outer cylindrical part 4 of housing 1. A passageway 39 is formed within the pump housing 11 in communication with the air inlet path 23. If desired, of course, the pump housing 11 as a separate and removable member could be eliminated and the functional portions thereof formed into the structure of the housing 11 itself. A suction pump, generally indicated as 18, is mounted within the passageway 39. Suction pump 18 will be discussed in greater detail shortly. An electric motor 12 is concentrically mounted within the head opening 19 below the blade block 3 and within the pump housing 11. Extending from the motor 12 are an upper shaft 15 and a lower shaft 16. A removable cover 13 below the motor 12 holds it in place. Lead wires 14 from the motor 12 are operably connected through the switch 2 to the batteries (not shown). The upper shaft 15 has the inner blade frame 7 carrying the inner blades 8 mounted thereto. Consequently, as motor 12 operates and shaft 15 is rotated, the inner blade frame 7 and inner blades 8 are rotated against the inner surface of the spherical outer blades 6.

The upper part of the pump housing 11 is of a double-wall construction having outer wall 21 and inner wall 22 which are cylindrical and concentrically disposed such that the channel comprising the air inlet path 23 surrounding the cutting head 20 is annular in shape.

To accomplish the objectives of the invention, it is preferred that a filter 25 be disposed within air inlet path 23. Filter 25 comprises two concentric cylindrical members 46, 47 of a material such as filter paper which are open at the end adjacent the blade block 3 and closed together at the inner end to form an annular filter cup within the air inlet path 23. Filter 25 is, therefore, able to contain a quantity of severed whiskers and, when full, can be removed with the whiskers in place to be disposed of in its entirety and then be replaced by a new, clean filter.

Turning now to FIGS. 3 and 4 in combination with FIG. 2, the operation of the suction pump 18 will be described. The suction pump 18 comprises a unitary member, generally indicated as 48, of an elastomeric material such as rubber. Member 48 is disposed over an opening 49 in the sidewall of the pump housing 11 defining the passageway 39. An inlet port 24 is formed adjacent the air inlet path 23 and an outlet port 31 is formed at the lower end adjacent an air discharge vent 34 in housing 1 which opens to the atmosphere. The unitary member 48 comprises a piston, generally indicated as 27, composed of an elastic film diaphragm 28 having a drive shaft 29 projecting from the central part thereof. An air inlet flapper valve 30 on one end is abutted to the inside surface of the inlet port 24 and an air outlet flapper valve 32 on the other end is abutted to the outside surface of the outlet port 31. An eccentric shaft 17 is connected to the lower shaft 16 to be driven thereby. Eccentric shaft 17 is inserted through a shaft slot 33 in the drive shaft 29 at its tip. Member 48 is held in place by the piston affixing member 26 as shown.

As the motor 12 revolves, the inner blades 8 turn, providing the shaving operation, and, at the same time, the suction pump 18 is also driven. As first shown in FIG. 3, as the drive shaft 29 is pulled outward by the revolving of the eccentric shaft 17 towards its outward position, the elastic film diaphragm 28 is pulled rightward (as FIG. 3) is viewed) by the drive shaft 29 and the inlet valve 30 is opened, thus causing air to be sucked in from the air inlet path 23 through the inlet port 24. At the same time, the outlet valve 32 is sucked against the outlet port 31 to close it.

Turning next to FIG. 4, as the eccentric shaft 17 is rotated towards its inner position, the drive shaft 29 and, with it, the elastic film diaphragm 28 is pushed leftward (as FIG. 4 is viewed) thus closing the inlet valve 30 and allowing the outlet valve 32 to open in order to expel the air inside of the chamber 50 of passageway 39 between the flapper valves 30, 32 to the atmosphere through the discharge vent 34.

By continued repetition of the above-described operation during the shaving process, negative pressure is developed inside the path 23. This partial vacuum, as shown by the arrows in FIG. 5, sucks the skin 35 into the channel of inlet path 23 surrounding the cutting head 20 allowing the skin 35 to come in close contact with the outer blades 6 while, at the same time, being well stretched. Consequently, not only is better close contact made between the outer blades 6 and the skin 35, but, additionally, the desired effect by projecting the mustache and beard hairs into the holes 38 is improved, thus enabling deeper and speedier shaving without stimulation. Additionally, since the skin 35 is either sucked into the inlet path 23, the hair shavings are either sucked into the inlet path 23, or stay inside of the blade block 3, without being scattered to the outside. The shavings sucked into the inlet path 23 are captured by the filter 25 to be thrown out in the detached filter 25 when desired.

It should be noted that according to the present invention, the motor 12 is used for simultaneously driving both the inner blades 8 and the suction pump 18, eliminating the use of two drive motors and, thus, providing a portion of the stated objectives, being a simplified, lightweight structure, and all at a moderate cost.

Turning now to FIGS. 6–8, a shaver according to the present invention in a second embodiment is shown. In this embodiment, the outer cylindrical part 4 of housing 1 has a collar 9 disposed to be about the outer periphery of the head opening 19 and, thereby, also about the outer periphery of the air inlet path 23. Collar 9 is mounted for axial movement between an extended position as shown in FIG. 7 and a retracted position with the shoulder 51 against the top of outer cylindrical part 4. A coil spring 42 is disposed between the top of pump housing 11 and the bottom of collar 9 to bias it to the extended position. A stepped portion at 41 prevents the collar 9 from extending beyond its desired limit. Biased axially-moving collar 9 is free to float between its extended and retracted positions as the shaver is held against the skin as shown in FIG. 8. This allows the outer periphery of the air inlet path 23 vis-a-vis the outer surface of the blade block 3 to adjust to fit contours of the skin 35 so as to effect a constant optimized relationship.

Another possible variation is shown in FIGS. 9 and 10. In this embodiment, the blade block 3 is slidably supported for axial movement on the inner wall 22 of the pump housing 11. It is retained by the stepped part 44 in slot 52 which allows for axial movement of the blade block 3' between an extended position as shown in FIG. 9 and a retracted position with blade block 3' moved closer to the top of the inner wall 22 adjacent motor 12. A coil spring 45 is disposed between the sliding blade block 3' and the top of the inner wall 22 to bias the sliding blade block 3' to its extended position. Accordingly, when the shaver of this embodiment is in operation as shown in FIG. 10, the blade block 3' is pushed by the skin 35 down to its most appropriate position relative to the top of the outer cylindrical part 4 so as to accommodate itself to the configuration of the skin 35 such that the close contact between the outer blade 6 and the skin 35 necessary to a close shave may be kept in an optimum state at all times. In order that the close contacting force between the outer blades 6 and the inner blades 8 not be changed even though the blade block 3' traverses axially between its extended and retracted position in this embodiment, the bottom surface 10 of the inner blade frame 7 is abutted onto the protruding surface 40 of the blade base 43, thereby providing a thrust bearing, and, additionally, the connection of the motor 12 to the upper shaft 15 is made by way of spline-coupling.

It should be understood by those skilled in the art that the sliding collar of FIG. 7 and the sliding blade block 3' of FIG. 9 could be combined together in one shaver to afford a combined floating arrangement of both components.

Thus, it can be seen that the shaver of the present invention provides a simple, lightweight, rotary head portable electric shaver which provides a partial vacuum-channel surrounding the cutting head which provides a first result of drawing the skin closely across and against the cutting head to extend the whiskers and, thereby, effect a closer shave while, at the same time and as a second result, further serving the purpose of sucking the severed hair shavings on the exterior of the cutting head into a disposable filter compartment.

Wherefore, having thus described my invention, I claim:

1. In an electric shaver comprising a housing with a powered shaving head for severing whiskers, the improvement comprising:

(a) a raised area in the housing surrounding the shaving head to form a channel around the shaving head; and (b) powered suction pump means disposed in said housing and communicating with said channel for creating a sucking force within said channel when the shaver is positioned against the skin for shaving to draw the skin into said channel such that the skin is stretched across and against the shaving head.

2. The shaver of claim 1 and additionally comprising:

a removable filter disposed in said channel.

3. The shaver of claim 2 wherein:

said filter comprises two spaced concentric cylindrical members open at one end adjacent said cutting head and closed together at the opposite end to form an annular cup within said channel opening adjacent said cutting head.

4. The shaver of claim 1 wherein said raised area comprises:

(a) a cylindrical collar disposed in the housing around the shaving head, said collar being axially slidable between extended and retracted positions; and including, (b) means for biasing said collar towards said extended position.

5. The shaver of claim 1 or claim 4 and additionally comprising:

(a) the shaver head being mounted for axial movement between extended and retracted positions; and, (b) means for biasing the shaving head towards said extended position.

6. The shaver of claim 1 wherein:

said suction pump is a diaphragm pump.

7. The shaver of claim 6 wherein:

(a) shaver includes an electric motor having a drive shaft extending from either end with the shaving head being operably connected to one end of said shaft to be driven thereby; and additionally, (b) an eccentric is connected to be driven by the other end of said shaft and operably connected to drive said diaphragm pump.

8. The shaver of claim 7 wherein:

said suction pump comprises a unitary member of an elastomeric material forming a diaphragm and two flapper valves disposed in a passageway in said body communicating with said channel such that said eccentric pulls on said diaphragm to thereby create a partial vacuum within said passageway, open a first one of said flapper valves disposed on the inlet side, and hold the other of said flapper valves disposed on the outlet side closed to draw air into the chamber within said passageway between said flapper valves and then releases the pull on said diaphragm whereby the elastomeric material retracting closes said first flapper valve, allows the other flapper valve to open, and expels air from said chamber.

9. An electric shaver comprising:

(a) a hollow body portion having a head opening therein;

(b) a cutting head disposed in said head opening to form a channel disposed about said head;

(c) a suction pump disposed within said body with an inlet in communication with said channel and an outlet in communication with the atmosphere; and, (d) means disposed in said body portion for driving said cutting head and said suction pump whereby a partial vacuum is created in said channel around said cutting head when said cutting head is being driven to thereby draw the skin into said channel and thereby stretched across and against said cutting head during shaving.

10. The shaver of claim 9 and additionally comprising:

a removable filter disposed in said channel.

11. The shaver of claim 10 wherein:

said filter comprises two spaced concentric cylindrical members open at one end adjacent said cutting head and closed together at the opposite end to form an annular cup within said channel opening adjacent said cutting head.

12. The shaver of claim 9 and additionally comprising:

(a) a collar disposed within said head opening adjacent the outer periphery thereof, said collar being axially slidable between extended and retracted positions within said head opening; and, (b) means for biasing said collar towards said extended position.

13. The shaver of claim 9 or claim 12 and additionally comprising:

(a) said cutting head being mounted for axial movement between extended and retracted positions; and, (b) means for biasing said cutting head towards said extended position.

14. The shaver of claim 9 wherein:

said suction pump is a diaphragm pump.

15. The shaver of claim 14 wherein:

(a) said driving means comprises an electric motor having a drive shaft extending from either end with said cutting head being operably connected to one end of said shaft to be driven thereby; and additionally, (b) an eccentric driven by the other end of said shaft and operably connected to drive said diaphragm pump.

16. The shaver of claim 15 wherein:

said suction pump comprises a unitary member of an elastomeric material forming a diaphragm and two flapper valves disposed in a passageway in said body communicating with said channel such that said eccentric pulls on said diaphragm to thereby create a partial vacuum within said passageway, open a first one of said flapper valves disposed on the inlet side, and hold the other of said flapper valves disposed on the outlet side closed to draw air into the chamber within said passageway between said flapper valves and then releases the pull on said diaphragm whereby the elastomeric material retracting closes said first flapper valve, allows the other flapper valve to open, and expels air from said chamber.

* * * * *